US005692649A

United States Patent [19]

Schwab

[11] Patent Number: 5,692,649

[45] Date of Patent: Dec. 2, 1997

[54] SUCTION AND FORCE PUMP FOR A CONTAINER PROVIDING FOR THE REMOVAL OF RESIDUAL AIR AFTER FILLING

[75] Inventor: Egon Schwab, Hofheim, Germany

[73] Assignee: Ursatec Verpackung GmbH, Germany

[21] Appl. No.: 669,556

[22] PCT Filed: Jan. 13, 1995

[86] PCT No.: PCT/EP95/00132

§ 371 Date: Sep. 19, 1996

§ 102(e) Date: Sep. 19, 1996

[87] PCT Pub. No.: WO95/19230

PCT Pub. Date: Jul. 20, 1995

[30] Foreign Application Priority Data

Jan. 14, 1994 [DE] Germany ..... 44 00 944.5

[51] Int. Cl.[6] ..... B65D 88/54

[52] U.S. Cl. ..... 222/321.3; 222/321.2; 222/321.9; 141/65

[58] Field of Search ..... 222/321.3, 321.4, 222/321.9, 321.2; 141/23, 26, 65, 66, 18, 20

[56] References Cited

U.S. PATENT DOCUMENTS 4,532,967 8/1985 Graf ..... 141/20 X 4,964,547 10/1990 Lina ..... 222/321.2

FOREIGN PATENT DOCUMENTS 0 201 701 3/1986 European Pat. Off. .

27 09 796 9/1978 Germany .

27 09 796 A1 9/1978 Germany .

41 39 555 C2 3/1993 Germany .

*Primary Examiner*—Gregory L. Huson

*Attorney, Agent, or Firm*—Scully, Scott, Murphy and Presser

[57] ABSTRACT

A suction and force pump for a fluid in a sealed fluid container makes possible the drawing off by suction of residual air after the filling of the container with fluid, with the piston (3) in a particular position in the pressure cylinder (8) of the pump, by means of the pump channel (7) of the pump itself. For this purpose there is provided a channel for drawing off the residual air by suction, from the upper side of the fluid container through openings (13), a gap between piston (3) and the internal wall of the pressure cylinder (8), which gap is sealed with respect to the pressure cylinder (8) only by means of a peripheral sealing lip (9), through the pressure chamber (6) to the pump channel (7). The valve (5) to the fluid container is thereby closeable independently of pressure during the pumping away, by means of a plunger (11).

9 Claims, 4 Drawing Sheets

Figure 1:
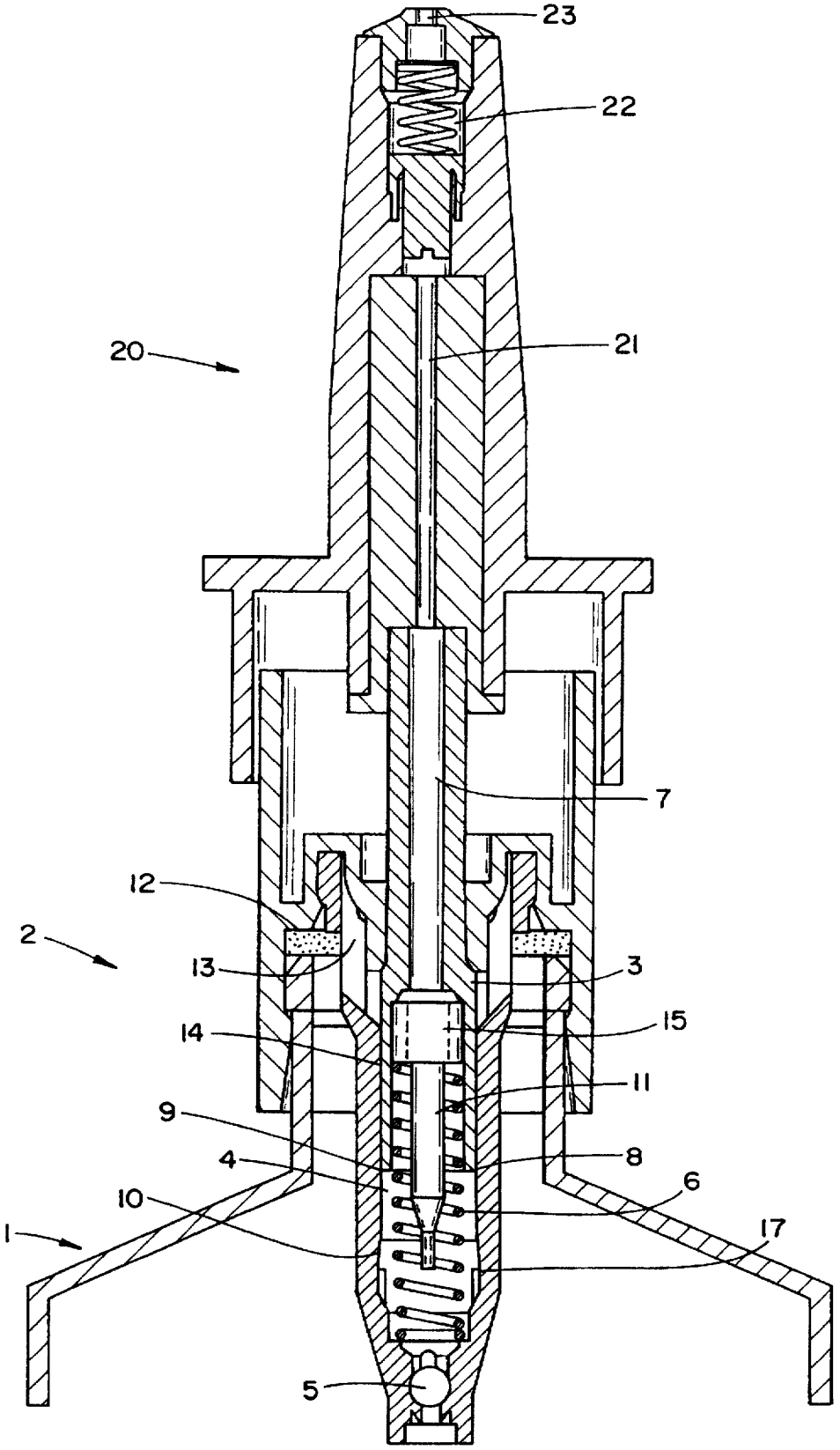

SUCTION AND FORCE PUMP FOR A CONTAINER PROVIDING FOR THE REMOVAL OF RESIDUAL AIR AFTER FILLING

The invention relates to a suction and force pump for a fluid in a sealed fluid container having a pressure cylinder protruding into the fluid container. A piston is sealingly guided in the pressure cylinder, and has an axial pump channel. A pressure chamber is formed in the pressure cylinder, which pressure chamber is bounded by the piston and by a valve effective with respect to the fluid container. The valve closes in the case of over-pressure, and opens in the case of under-pressure, and is connected with the axial pump channel.

Such a suction and force pump is known for example from German patent specification DE 27 09 796 C3. The liquid to be sprayed is found in a sealed fluid container into which the suction and force pump protrudes. A piston runs in a pressure cylinder which piston upwardly bounds a pressure chamber. This pressure chamber is connected with the fluid container by means of a valve. In the interior of the piston there is an axial pump channel for transportation of the fluid out of the pressure chamber to a discharge opening. The piston is held in an upper rest position by means of spring force. When the user presses the piston downwardly, e.g. by means of an actuating element that can be placed thereon, the pressure in the pressure chamber thus increases, the valve closes with regard to the fluid container, and the liquid in the pressure chamber escapes under pressure to the outside, by means of the axial pump channel. When the user releases the actuating element for the piston, the piston is thus urged upwardly by means of the spring force whereby an under-pressure comes about in the pressure chamber and the valve to the fluid container opens so that liquid can again flow into the pressure chamber.

Such suction and force pumps are used also for liquids which are to be stored in as sterile conditions as possible, for example for medical applications. Likewise, such pumps are used for spraying liquids for which contact with oxygen in the air leads to a reduction of the life of the liquid. For such applications, there is described in German patent application DE 41 39 555 C2 a suction and force pump having a fluid container which has an additional deformable internal bag sealed off against the atmosphere, so that the under-pressure caused in the fluid container by liquid flowing into the pressure chamber does not lead to a flow of air into the fluid container.

However, such suction and force pumps not having air compensation have the disadvantage that upon filling of the container residual air stays in the fluid container and that this cannot be removed. Thus, the liquid is constantly in contact with oxygen in the air which leads to a reduction of the storage time or the sterility of the liquid. A filling of the fluid container in a sterile atmosphere or under a protective gas is, however, very complex and expensive.

The invention thus has the object to provide a pressure-suction pump with which, after the filling procedure, the removal of residual air is possible in a simple way.

This object is achieved by the combination of features characterized in that the piston is sealed in the pressure cylinder only by a peripheral sealing lip. The pressure cylinder has a region in which the sealing lip has no sealing effect. The axial pump channel has an internal diameter of such size that a plunger can be passed therethrough, with which plunger the valve to the fluid container can be closed independently of pressure. A plunger is connected with the piston, which plunger, in the lowest position of the piston, closes the valve to the fluid container independently of pressure. The pressure cylinder has openings to the upper part of the fluid container for drawing off by suction any residual air in the fluid container.

In order to be able to draw off the residual air by suction, with a closed container, that is with a dosing pump set in place, there are provided in the pressure cylinder openings to the upper part of the fluid container. The piston is guided sealingly in the greater part of the pressure cylinder solely by means of a peripheral sealing lip. Thus, in a particular position of the piston, air can flow by out of the upper part of the fluid container between piston and pressure cylinder into the pressure chamber and the pump channel. Further, the pump channel is provided to be so broad that it is possible to pass a plunger therethrough with which the ball valve between pressure chamber and fluid container can be closed in a pressure independent manner. If one then applies vacuum to the axial pump channel in the above-mentioned piston position and one closes the ball valve at the same time, no fluid can escape out of the fluid container because of the under-pressure in the pressure chamber, rather only the residual air in the upper part of the container is drawn off by suction. If liquid finally escapes through the axial pump channel to the outside it is thus reliably ensured that no more residual air is present in the fluid container or in the pressure chamber. The actuation path of the piston in the pressure cylinder where the sealing lip seals, is available for building up pressure for the spraying of the liquid as described above.

The advantage of the invention is found in that residual air can be drawn off out of a sealed fluid container by suction through the pump and it can easily be checked whether all the residual air has been removed.

A further advantage is found in that it is easily possible to fill the pressure chamber with liquid, i.e. to prime the pump. This characteristic is advantageous in particular with the use of thixotropic liquids.

In a further development of the invention, a plunger is connected with the piston itself, so that in the lowest position of the piston the valve between fluid container and pressure chamber is closed. Thereby, the residual air can be removed from the fluid container in that the piston is simply pressed downwardly—thereby the valve is simultaneously closed and a connection between the axial pump channel and the fluid container is brought about—and the pump channel is acted upon with a vacuum.

In a further development of the invention, the plunger may have a narrow forward region for actuation of the valve and a broader region having a star-like cross-section for retention in the pump channel.

Further, a lower stop for the piston may be provided, so that the plunger just closes the valve but cannot cause damage through too strong a pressure.

The valve between pressure chamber and fluid container is advantageously formed as a ball valve.

Particularly advantageous is a development of the invention with which the sealing lip is formed at the lower end of the piston and the region of the pressure cylinder in which the sealing lip is not sealingly effective is likewise provided at the lower end of the pressure chamber.

The suction and force pump in accordance with the invention may be provided with a manual actuation element, with which the pressure force is exercised on the piston, which manual actuation element is placed on the axial channel and has a lifting tube leading to an exit opening or exit nozzle. This actuating element may have an over-pressure valve as is e.g. described in the patent specification DE 27 09 796 C3.

Figure 2:
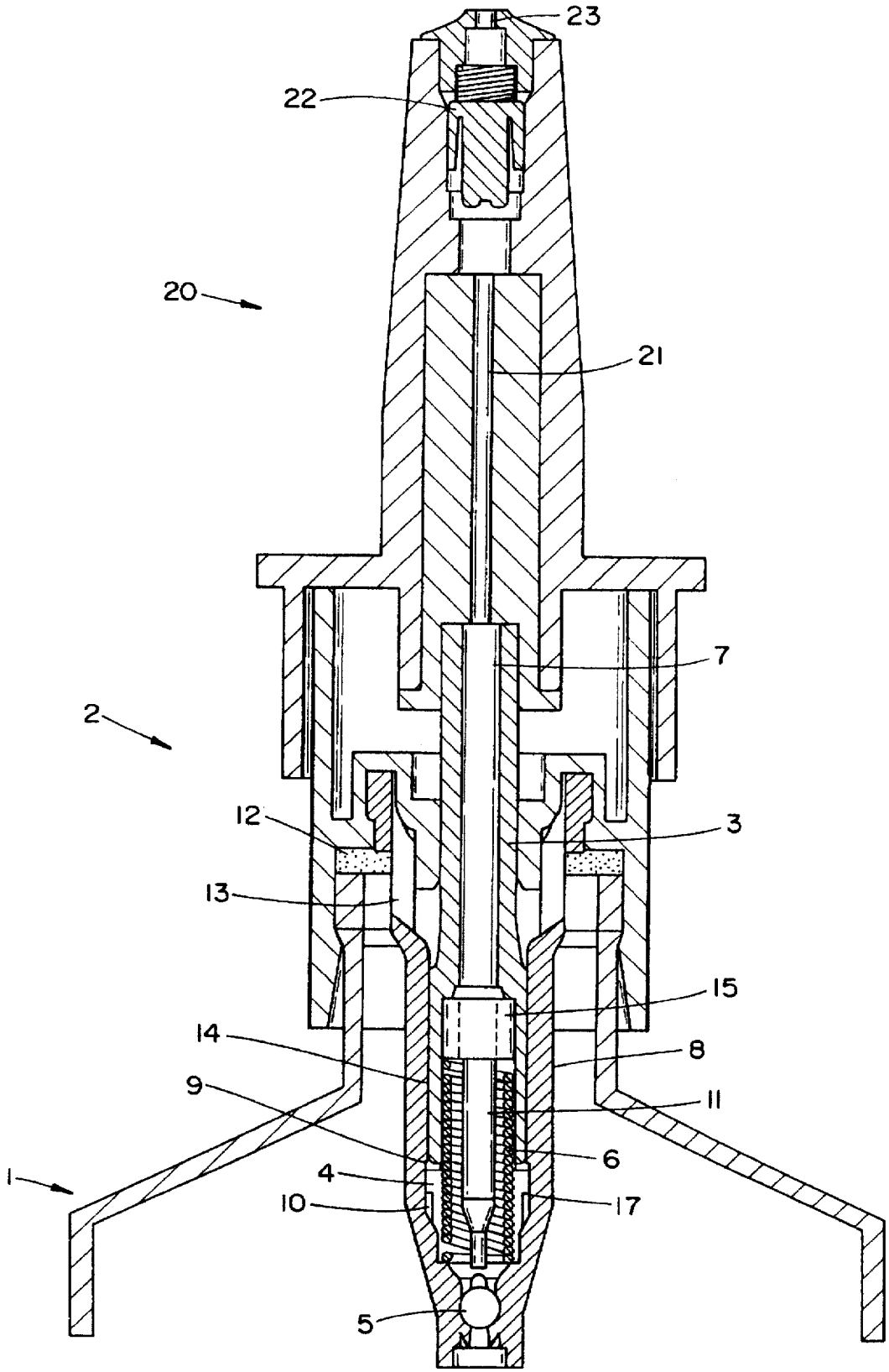
Figure 3:
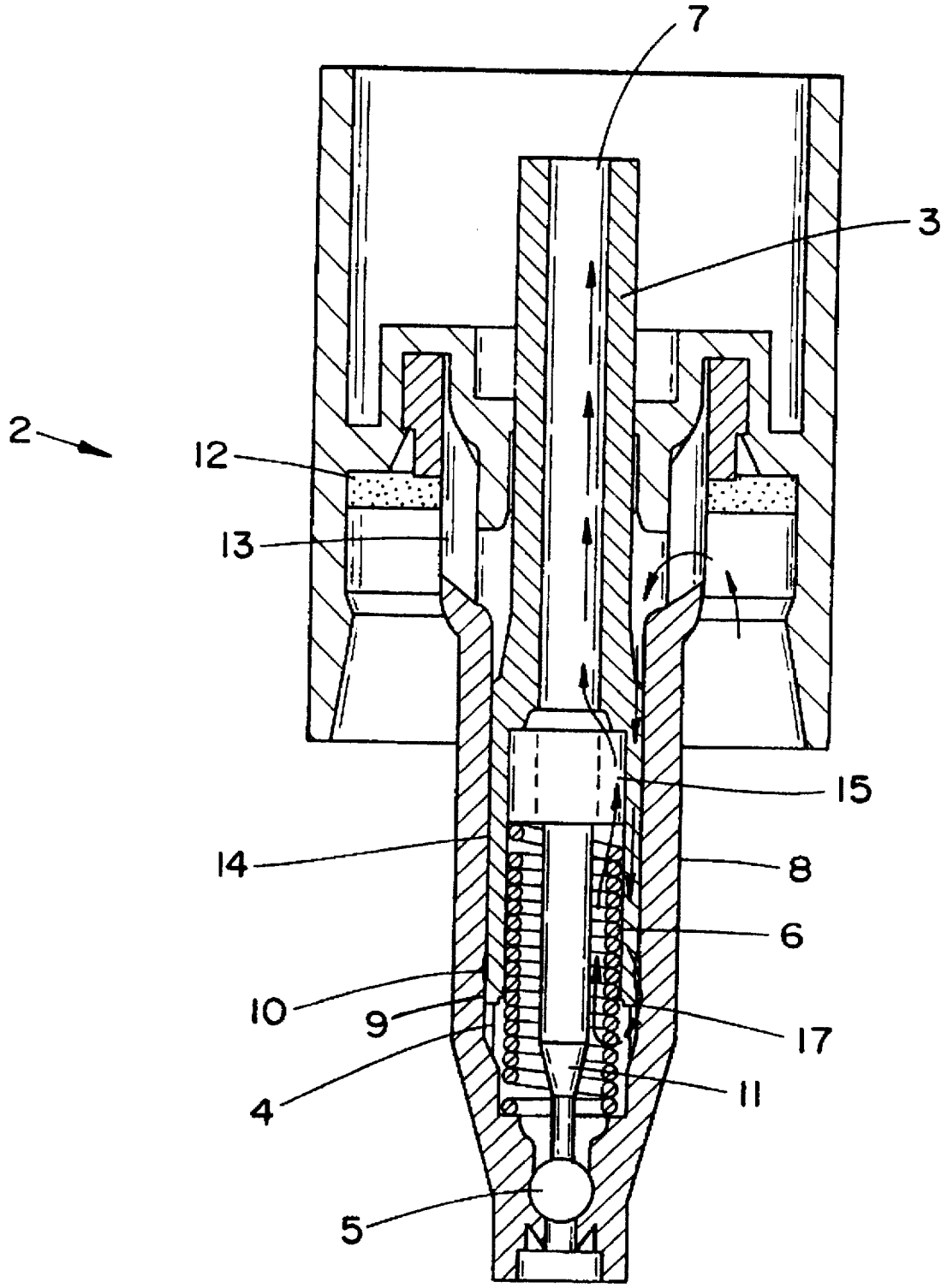
Figure 4:
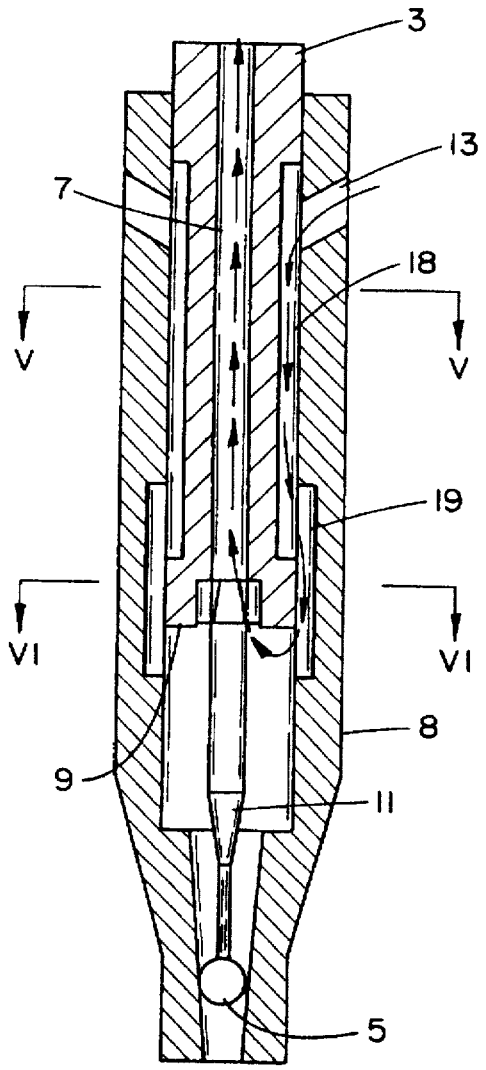
Figure 5:
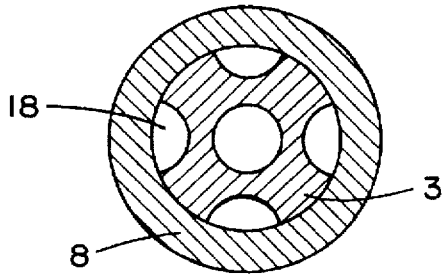
Figure 6:
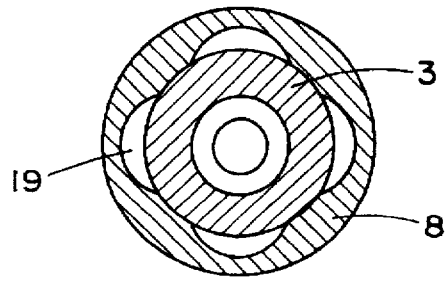

Below, the invention will be described in detail with reference to the drawings, which show:

FIG. 1 a longitudinal section through a suction and force pump in accordance with the invention, with actuating part placed thereon, in the upper rest position, FIG. 2 a section through a suction and force pump in accordance with the invention, with actuating part placed thereon, in the lower actuation position, FIG. 3 a longitudinal section through a suction and force pump in accordance with the invention, in actuation position, FIG. 4 a schematic representation of pressure cylinder and piston of a second exemplary embodiment of a suction and force pump in accordance with the invention, FIG. 5 a cross section along the line V—V in FIG. 4, and FIG. 6 a cross section along the line VI—VI in FIG. 5.

The suction and force pump 2 is placed sealingly, by means of the sealing ring 12, on a fluid container 1 here only partially represented. A piston 3 having an axial pump channel 7 runs in the pressure cylinder 8. The piston 3 is held against a stop in its upper rest position by a spring 6. The pressure chamber 4 is located between the piston 3 and the ball valve 5, which pressure chamber is connected with the axial pump channel 7. The piston has a smaller external diameter than the internal diameter of the pressure cylinder 8, so that there remains a gap 14 between the piston outer wall and the cylinder inner wall which is, however, closed below by the peripheral sealing lip 9 of the piston. In the lower region of the pressure chamber 4, the pressure cylinder 8 has a section 10 with greater internal diameter in which the sealing lip 9 does not work sealingly. An actuating element 20 placed upon the piston 3 has a lifting tube 21 with an over-pressure valve 22 for dispensation of the fluid through a discharge opening 23. In the upper rest position of the piston 3, illustrated in FIG. 1, the sealing lip 9 seals off the pressure chamber 4 with respect to the openings 13 to the fluid container 1. The plunger 11 is fixedly connected with the piston 3, whereby the section 15 having star-like cross-section leaves free a connection between pressure chamber 4 and pump channel 7. In the rest position of the pump, the plunger 11 has a spacing from the ball valve 5 so that this opens when there is over-pressure in the pressure chamber 4 relative to the fluid container 1, and closes in the case of under-pressure.

In FIG. 2 and FIG. 3, the piston 3 is shown in its lowest position. The spring 6 is almost completely compressed. The plunger 11 closes the ball valve 5 independently of the pressure in the pressure chamber 4 or the fluid container 1. As can be seen best from FIG. 3, there is now provided a connection, illustrated by arrows, between the interior of the fluid container 1 via the openings 13, the gap 14 between pressure cylinder 8 and piston 3, the gap between the section 10 of the pressure cylinder 8 of larger bore and the sealing lip 9 and via the star-like section 15 of the plunger 11, to the pump channel 7. If one acts upon the pump channel with a vacuum, residual air can thus be pumped off from the upper end of the fluid container 1 via the path mentioned above. The ball valve 5 thereby remains reliably closed in order that no fluid is sucked up. A stop 17 provides that, upon pressing down of the piston 3, the valve ball 5 is not displaced from its mounting by the plunger 11.

For actuation of the pump there thus remains a shortened actuation path of the piston 3, along the section of the pressure cylinder 8 in which the sealing lip 9 is sealingly guided. Length and diameter of the pressure chamber 4 can be so chosen that a sufficient volume of liquid can be transported with each piston movement.

In FIGS. 4 to 6, a second exemplary embodiment of a suction and force pump in accordance with the invention is shown. FIG. 4 shows, in longitudinal section, the pressure cylinder 8, in which the piston 3 is sealingly guided. The piston 3, having constant diameter, has above the sealing lip 9 axially outer recesses 18. Likewise, as can be seen from the cross-sectional illustration in FIG. 6, inner axial recesses 19 are formed in the lower region of the pressure cylinder 8. Thus, with the piston 3 pressed down, there is provided again a connection from the fluid container through the openings 13, the recesses 18 and 19, the section 15 of the plunger having star-like cross-section, to the pump channel 7, via which the residual air can be drawn off by suction out of the fluid container.

I claim:

1. A suction and force pump for a fluid in a sealed fluid container (1), having:

a pressure cylinder (8) protruding into the fluid container (1), a piston (3), sealingly guided in the pressure cylinder (8), having an axial pump channel (7), a pressure chamber (4) formed in the pressure cylinder (8), which pressure chamber is bounded by the piston (3) and by a valve (5) effective with respect to the fluid container (1), which valve closes in the case of over-pressure and opens in the case of under-pressure, and which is connected with the axial pump channel (7), characterized in that, the piston (3) is sealed in the pressure cylinder (8) only by a peripheral sealing lip (9), the pressure cylinder (8) has a region (10) in which the sealing lip (9) has no sealing effect, the axial pump channel (7) has an internal diameter of such size that a plunger can be passed therethrough, with which plunger the valve (5) to the fluid container (1) can be closed independently of pressure, a plunger (11) is connected with the piston (3), which plunger, in the lowest position of the piston (3), closes the valve (5) to the fluid container (1) independently of pressure, and the pressure cylinder (8) has openings to the upper part of the fluid container (1), for drawing off by suction residual air in the fluid container (1).

2. A suction and force pump according to claim 1, characterized in that, the plunger (11) has a lower narrow region for actuation of the valve (5) and an upper broader region (15), having a star-like cross-section, for retention in the pump channel (7).

3. A suction and force pump according to claim 1, characterized in that, a lower stop (17) is provided for the piston (3).

4. A suction and force pump according to claim 1, characterized in that, the valve (5) between the pressure chamber (4) and the fluid container (1) comprises a ball valve.

5. A suction and force pump according to claim 1, characterized in that, the sealing lip (9) is located at the lower end of the piston (3), and the region (10) of the pressure cylinder (8), in which the sealing lip (9) does not work sealingly, is located at the lower end of the pressure chamber (4).

6. A suction and force pump according to claim 1, characterized in that, the piston (3) has a smaller outer diameter than the inner diameter of the pressure cylinder (8), and the region (10) of the pressure cylinder (8), in which the sealing lip (9) of the piston (3) does not work sealingly, has a larger internal diameter than the outer diameter of the sealing lip (9).

7. A suction and force pump according to claim 1, characterized in that, the piston (3), inclusive of sealing lip (9), has a uniform outer diameter, and the pressure cylinder (8) has a uniform inner diameter, and outer axial recesses (18) are provided in the piston (3) above the sealing lip (9), and inner axial recesses (19) are formed in the region (10) of the pressure cylinder (8) in which the sealing lip (9) does not work sealingly.

8. A suction and force pump according to claim 1, characterized in that, there is provided an actuating element (20), having a lifting tube (21) opening into a fluid discharge (23) and placeable on the piston (3), which lifting tube (21) is connected with the axial pump channel (7) formed in the piston (3).

9. A suction and force pump according to claim 8, characterized in that, an over-pressure valve (22) is provided in the lifting tube (21) of the actuating element (20).

* * * * *